US010500436B1

(12) United States Patent
Lu

(10) Patent No.: US 10,500,436 B1
(45) **Date of Patent: *Dec. 10, 2019**

(54) LINKAGE ASSEMBLIES FOR EXERCISE DEVICES

(71) Applicant: Brunswick Corporation, Lake Forest, IL (US)

(72) Inventor: Zhi Lu, Glenview, IL (US)

(73) Assignee: Life Fitness, LLC, Rosemont, IL (US)

( * ) Notice: Subject to any disclaimer, the term of this patent is extended or adjusted under 35 U.S.C. 154(b) by 141 days.

This patent is subject to a terminal disclaimer.

(21) Appl. No.: 15/723,740

(22) Filed: Oct. 3, 2017

Related U.S. Application Data

(63) Continuation of application No. 15/012,324, filed on Feb. 1, 2016, now Pat. No. 9,925,412.

(51) Int. Cl.
*A63B 22/06* (2006.01)
*A63B 23/035* (2006.01)
*A63B 22/00* (2006.01)

(52) U.S. Cl.
CPC ..... *A63B 22/0664* (2013.01); *A63B 22/001* (2013.01); *A63B 23/03575* (2013.01); *A63B 2022/0676* (2013.01)

(58) Field of Classification Search
CPC ... A63B 22/0664–0694; A63B 22/0005–0012; A63B 2022/0028–0043; A63B 2022/2067–0688
See application file for complete search history.

(56) References Cited

U.S. PATENT DOCUMENTS

| | | | | |
|---|---|---|---|---|
| 6,084,325 | A | 7/2000 | Hsu | |
| 7,479,093 | B1 | 1/2009 | Immordino et al. | |
| 7,625,317 | B2 | 12/2009 | Stevenson et al. | |
| 7,717,833 | B1 | 5/2010 | Nelson et al. | |
| 7,918,766 | B2 | 4/2011 | Lu et al. | |
| 7,931,566 | B1 | 4/2011 | Radke et al. | |
| 8,272,997 | B2 | 9/2012 | Anderson et al. | |
| 9,050,498 | B2 | 6/2015 | Lu et al. | |
| 9,114,275 | B2 | 8/2015 | Lu et al. | |
| 9,138,614 | B2 | 9/2015 | Lu et al. | |
| 2008/0020902 | A1* | 1/2008 | Arnold | A63B 22/001 482/51 |
| 2008/0027400 | A1* | 1/2008 | Harding | A61M 25/0017 604/265 |
| 2008/0242516 | A1 | 10/2008 | Liu | |
| 2008/0269023 | A1 | 10/2008 | Chuang | |

(Continued)

*Primary Examiner* — Nyca T Nguyen
(74) *Attorney, Agent, or Firm* — Andrus Intellectual Property Law, LLP

(57) ABSTRACT

An exercise device includes a linkage assembly that links a driving member to a driven member such that circular rotation of the driving member causes generally equal circular rotation of the driven member. The linkage assembly includes a linking member, a first crank arm that connects the driving member to the linking member such that rotation of the driving member causes motion of the linking member, and a second crank arm that connects the linking member to the driven member such that the motion of the linking member causes rotation of the driven member. At least one additional crank arm connects the linking member at a rotational axis that is laterally offset from a straight line through the first and second crank arm rotational axes.

20 Claims, 6 Drawing Sheets

(56) References Cited

U.S. PATENT DOCUMENTS

| | | | | |
|---|---|---|---|---|
| 2009/0105049 | A1* | 4/2009 | Miller | A63B 22/001 482/52 |
| 2009/0176625 | A1 | 7/2009 | Giannelli | |
| 2009/0209394 | A1* | 8/2009 | Kwon | A63B 22/001 482/52 |
| 2012/0322624 | A1 | 12/2012 | Wu | |
| 2013/0143720 | A1* | 6/2013 | Chuang | A63B 22/0664 482/52 |
| 2014/0141939 | A1 | 5/2014 | Wu | |
| 2014/0194256 | A1 | 7/2014 | Huang | |
| 2015/0246260 | A1 | 9/2015 | Giannelli | |
| 2015/0335943 | A1* | 11/2015 | Miller | A63B 22/0664 482/52 |

* cited by examiner

LINKAGE ASSEMBLIES FOR EXERCISE DEVICES

CROSS REFERENCE TO RELATED APPLICATION

This application is a continuation of U.S. patent application Ser. No. 15/012,324, filed Feb. 1, 2016, which is incorporated herein by reference in entirety.

FIELD

The present disclosure relates to exercise devices, specifically to linkage assemblies for exercise devices.

BACKGROUND

The following U.S. patents are hereby incorporated by reference in their entirety:

U.S. Pat. No. 7,479,093 discloses an exercise apparatus having a pair of handles pivotally mounted on a frame and guiding respective user arm motions along swing paths obliquely approaching the sagittal plane of the user.

U.S. Pat. No. 7,625,317 discloses an exercise apparatus with a coupled mechanism providing coupled natural biomechanical three dimensional human motion.

U.S. Pat. No. 7,918,766 discloses an exercise apparatus for providing elliptical foot motion that utilizes a pair of rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

U.S. Pat. No. 7,931,566 discloses an exercise apparatus, which may be an elliptical cross trainer, having a rotating inertial flywheel driven by user-engaged linkage exercising a user. A user-actuated resistance device engages and stops rotation of the flywheel upon actuation by the user.

U.S. Pat. No. 9,050,498 discloses an exercise assembly comprising a frame and elongated foot pedal members that are each movable along user-defined paths of differing dimensions. Each foot pedal member has a front portion and a rear portion. Footpads are disposed on the rear portion of one of the pair of foot pedal members. Elongated coupler arms have a lower portion and an upper portion that is pivotally connected to the frame. Crank members have a first portion that is pivotally connected to the front portion of one of the pan of foot pedal members and have a second portion that is pivotally connected to the lower portion of one of the pair of coupler arms, such that each crank member is rotatable in a circular path. Elongated rocker arms have a lower portion that is pivotally connected to one of the pair of foot pedal members in between the foot pad and the crank member and have an upper portion that is pivotally connected to the frame U.S. Pat. No. 9,114,275 discloses an exercise assembly including a frame, a pair of elongated foot pedal members, a pair of elongated coupler arms, a pair of crank members, a pair of elongated rocker arms, and a front cross-shaft. The pair of foot pedal members are each movable along user-defined paths of different dimensions. Each crank member is rotatable in a circular path and is freely rotatable along the circular path in a first direction and restrained from rotation along the circular path in a second, opposite direction.

U.S. Pat. No. 9,138,614 discloses an exercise assembly comprising elongated first and second rocker arms that pivot with respect to each other in a scissors-like motion about a first pivot axis. A slider has a slider body that slides along a linear axis extending through and perpendicular to the first pivot axis. A linkage pivotally couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an exercise device includes a driving member, a driven member, and a linkage assembly that links the driving member to the driven member such that rotation of the driving member causes rotation of the driven member. The linkage assembly includes a linking member, a base member that connects the driving member and the driven member, a first crank arm that connects the driving member to the linking member such that rotation of the driving member causes motion of the linking member, a second crank arm that connects the linking member to the driven member such that the motion of the linking member causes rotation of the driven member, and a third crank arm that connects the linking member to the base member such that the motion of the linking member causes the third crank arm to rotate with respect to the base member.

In certain examples, an exercise device includes a driving member, a driven member, and a linkage assembly that links the driving member to the driven member such that rotation of the driving member causes rotation of the driven member. The linkage assembly includes a linking member, a base member that connects the driving member and the driven member, a first crank arm that connects the driving member to the linking member such that rotation of the driving member causes motion of the linking member, a second crank arm that connects the linking member to the driven member such that the motion of the linking member causes rotation of the driven member, and a third crank arm that connects the linking member to the base member such that the motion of the linking member causes the third crank arm to rotate with respect to the base member. The first, second, and third crank arms extend in a common plane and remain parallel to each other as the driving member rotates, and the third crank arm rotational axis is laterally offset from a straight line extending through the first and second crank arm rotational axes. The driving crank arm drives rotation of the driving member.

In certain examples, an exercise device includes a frame, a pedal member having a first portion and a second portion, and a base member having a first portion and a second portion. The second portion of the base member is pivotally coupled to the frame via a driven member. A crank arm has a first portion that is pivotally coupled to the first portion of the pedal member and a second portion that is pivotally coupled to the first portion of the base member via a driving member. The crank arm is rotatable in a circular path entirely around the first portion of the base member as the base member pivots back and forth with respect to the frame such that the pedal member is movable along user defined paths of differing dimensions. A linkage assembly links the driving member to the driven member such that rotation of the driving member causes rotation of the driven member. The linkage assembly includes a linking member, a first crank arm that connects the driving member to the linking member at a first crank arm rotational axis such that rotation of the driving member causes motion of the linking member, a second crank arm that connects the linking member to the driven member at a second crank arm rotational axis such that rotation of the linking member causes rotation of the driven member and a third crank arm that connects the linking member to the base member at a third rotational axis such that the motion of the of the linking member causes the third crank arm to rotate with respect to the base member. The first, second, and third crank arms extend in a common plane and remain parallel to each other as the driving member rotates. The third crank arm rotational axis is laterally offset from a straight line extending through the first and second crank arm rotational axes.

BRIEF DESCRIPTION OF THE DRAWINGS

Examples of exercise devices are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different assemblies and apparatuses described herein may be used alone or in combination with other assemblies and apparatuses. Various equivalents, alternatives, and modifications are possible within the scope of the appended claims.

Figure 1:
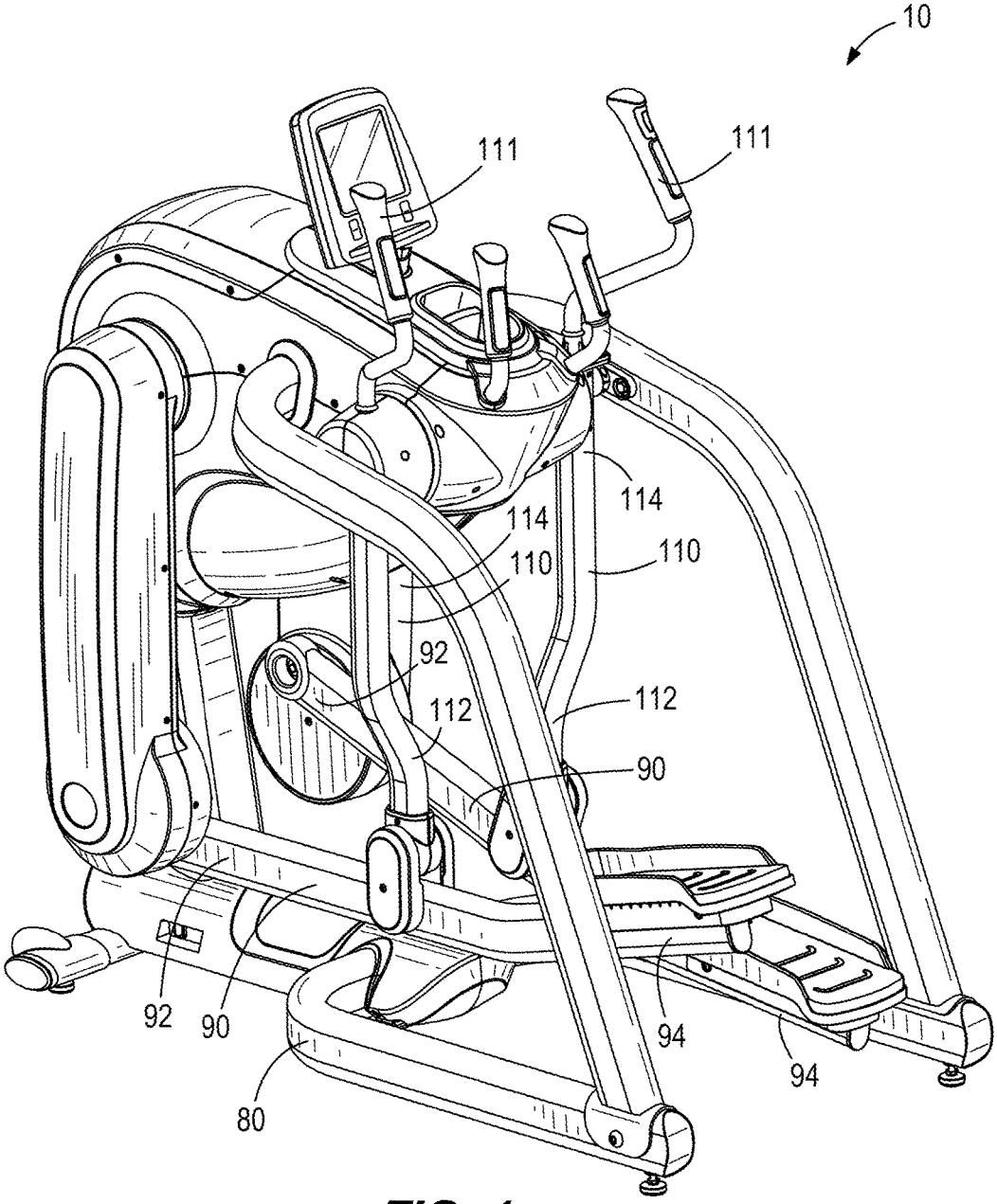
FIG. 1 is a perspective view of an exercise device.

FIGS. 1-7 depict an exercise device 10 which includes a linkage assembly 40 that links a driving member 20 to a driven member 30 wherein rotation of the driving member 20 causes rotation of the driven member 30. Referring to FIG. 1, the exercise device 10 includes a frame 80 which supports a pair of rocker arms 110 and a pair of pedal members 90. Each rocker arm 110 has first portion 112 that is pivotably coupled or connected, directly or indirectly, to a pedal member 90 between first and second portions 92, 94 and a second portion 114 that is pivotably coupled to the frame 80. In operation, a user stands on the pedal members 90 and grasps handles 111 connected to the rocker arms 110. To exercise, the user moves the pedal members 90 and rocker arms 110 forward toward the front of the exercise device 10 and backward toward the rear of the exercise device 10. The configuration of the linkage assembly 40, pedal members 90, and rocker arms 110 allow the user to vary stride length and/or depth during exercise. (see also U.S. Pat. No. 9,114,275 incorporated herein by reference).

Figure 2:
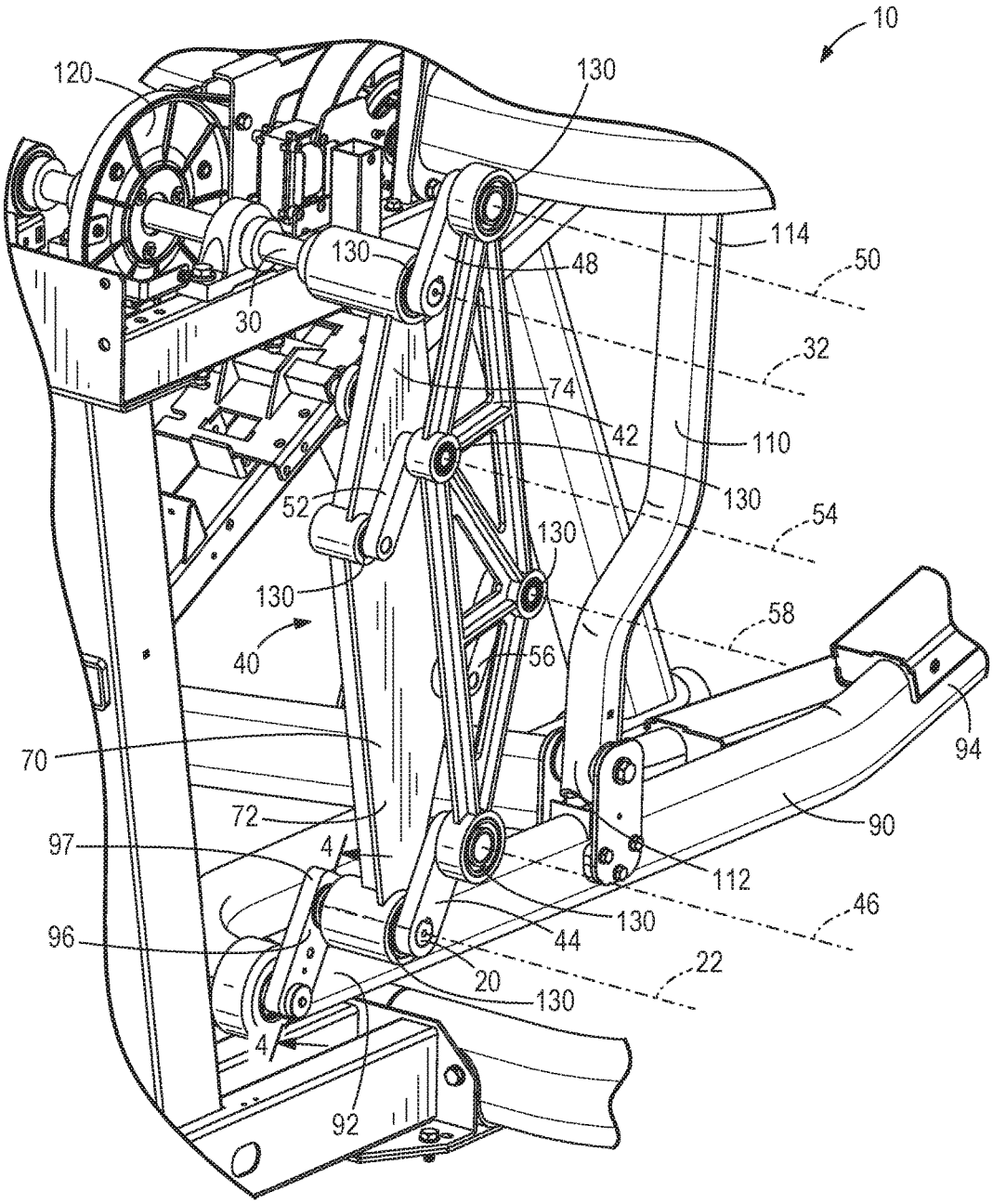
FIG. 2 is a cut-away view of the exercise device of FIG. 1 showing a linkage assembly.

Referring to FIG. 2, operation of the exercise device 10 causes a drive member 20 to rotate. The linkage assembly 40 is connected to the driving member 20 and links the driving member 20 to a driven member 30. As the driving member 20 rotates, the linkage assembly 40 moves thereby rotating the driven member 30. The linkage assembly 40 includes a linking member 42, a first crank arm 44, and a second crank arm 48. The first crank arm 44 connects the driving member 20 to the linking member 42 such that rotation of the driving member 20 causes motion of the linking member 42. The second crank arm 48 connects the linking member 42 to the driven member 30 such that the motion of the linking member 42 causes rotation of the driven member 30. As further described herein below with respect to FIGS. 5-7, the first and second crank arms 44, 48 extend in a common plane and remain parallel to each other as the driving member 20 is rotated, and a third crank arm 52 and optionally a fourth crank arm 56 can be included such that the third and optional fourth crank arms 52, 56 extend in the common plane in which the first and second crank arms 33, 48 extend. The third and fourth crank arms 52, 56 remain parallel to each other and/or the first and second crank arms 44, 48. In non-limiting examples, a crank arm 96 drives rotation of the driving member 20 and the rotation of the driven member 30 is slowed by a resistance member 120 connected to the driven member 30.

Figure 3:
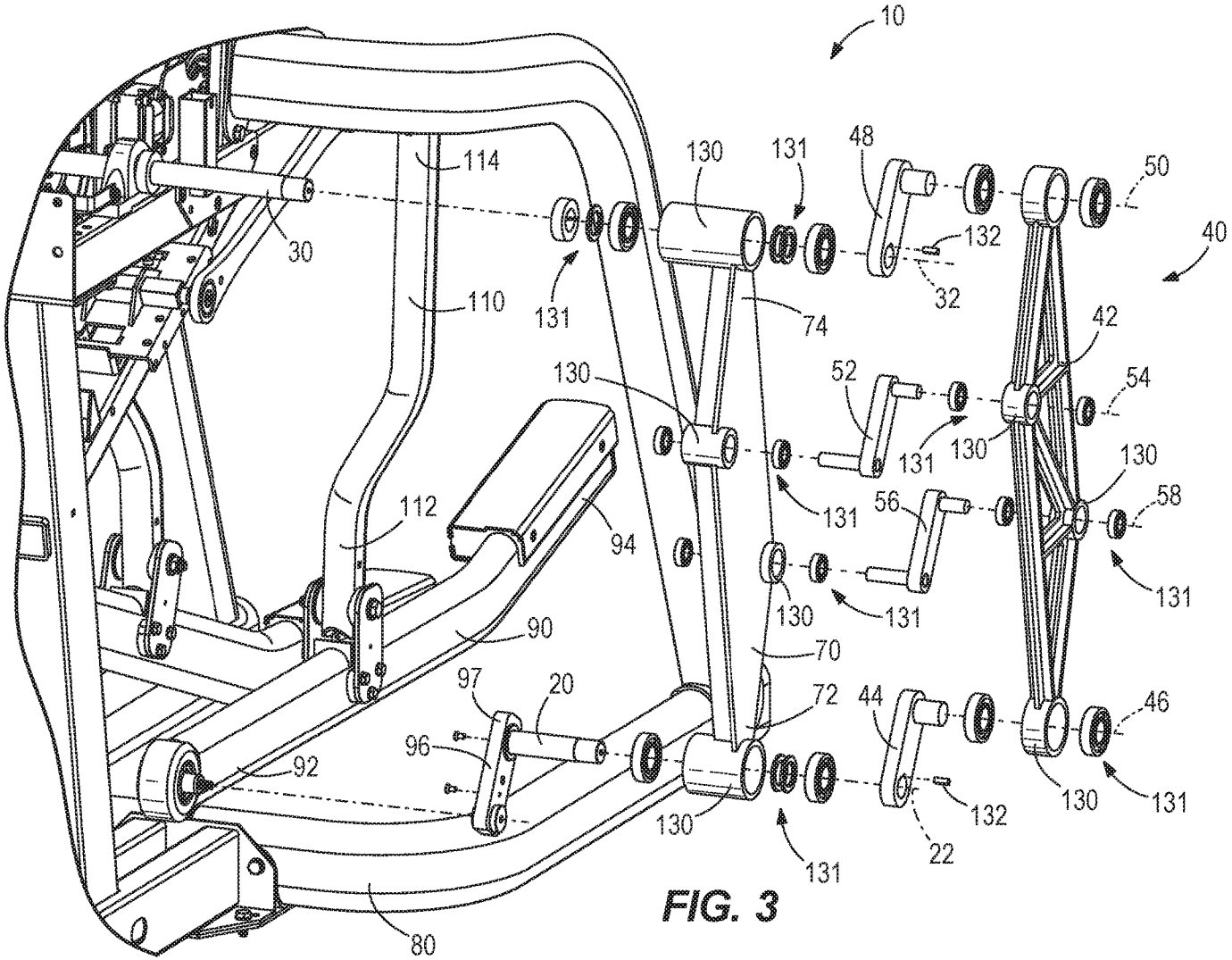
FIG. 3 is an exploded view of the linkage assembly of FIG. 2.
Figure 4:
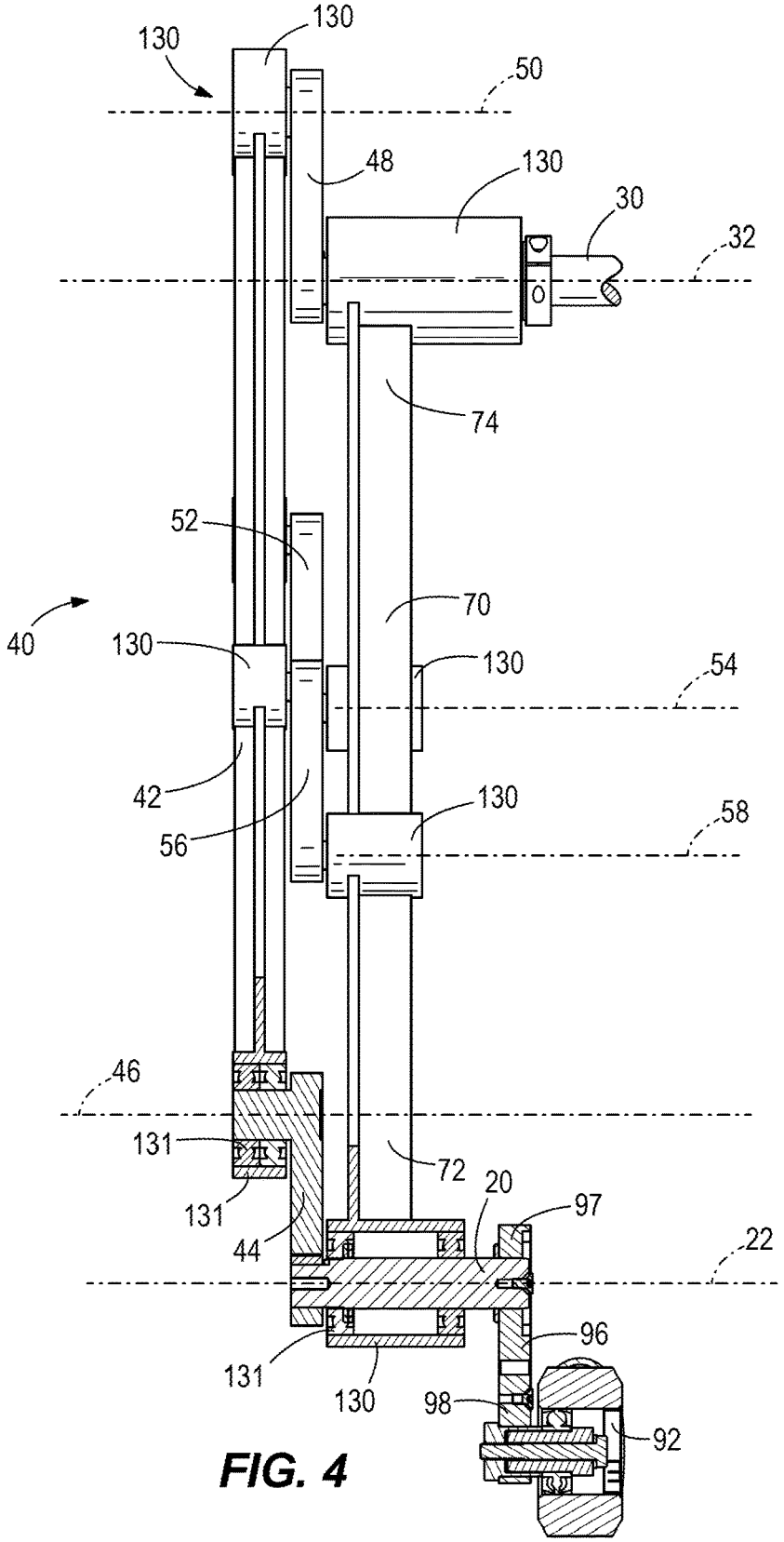
FIG. 4 is section view of the linkage assembly of FIG. 2.

Referring to FIGS. 3 & 4, the linkage assembly 40 is shown in greater detail. The first crank arm 44 is connected to the driving member 20 at a driving member rotational axis 22, and the second crank arm 48 is connected to the driven member 30 at a driven member rotational axis 32. The driving member rotational axis 22 and the driven member rotational axis 32 are parallel and spaced apart with respect to each other. The first and second crank arms 44, 48 are connected to the linking member 42 such that the first crank arm 44 is connected to the linking member 42 at a first crank arm rotational axis 46 and the second crank arm 48 is connected to the linking member 42 at a second crank arm rotational axis 50. The first crank arm rotational axis 46 and the second crank arm rotational axis 50 are parallel and spaced apart with respect to each other.

Rotation of the driving member 20 causes: the first crank arm 44 to rotate about the driving member rotational axis 22; the linking member 42 to move relative to the driving member rotational axis 22 and the driven member rotational axis 32; and the second crank arm 48 to rotate about the driven member rotational axis 32. The linkage assembly 40 includes a base member 70 which connects the driving member 20 and the driven member 30. The base member 70 supports rotation of the driving member 20, driven member 30, first crank arm 44, second crank arm 48 and motion of the linking member 42 such that the motion of the linking member 42 is translation along a circular path with respect to the base member 70. (see FIGS. 5-7).

The connection of the first and second crank arms 44, 48 to the driving member 20, driven member 30, base member 70, and linking member 42, respectively, is facilitated by bearing and through shaft assemblies 131 which are positioned in bearing housings 130. The bearing housings 130 are connected to the base member 70 and linking member 42, respectively. Locking keys 132 create a fixed rotational connection between the linkage assembly 40 and the driving member 20 and driven member 30. In certain examples, the linking member 42 is a truss having a plurality of elongated members connected to the bearing housings 130. In other examples, the linking member 42 is a polygon shaped plate.

The base member 70 supports rotation of the driving member 20, the driven member 30, the first crank arm 44, the second crank arm 48, the third crank arm 52, and the fourth crank arm 56 with respect to the base member 70. The base member 70 can include a plurality of bearing housings 130 that house a plurality of bearing and through shaft assemblies 131 for facilitating the connection of the driving member 20, driven member 30, first crank arm 44, second crank arm 48, third crank arm 52, and/or fourth crank arm 56 to the base member 70. In certain examples, the base member 70 is a polygon shaped plate. In other examples, the base member is a truss. The base member 70 may be shaped similar to the linking member 42.

The third crank arm 52 connects the linking member 42 to the base member 70. The third crank arm 52 is connected to the linking member 42 at a third crank arm rotational axis 54. Motion of the linking member 42 causes the third crank arm 52 to rotate with respect to the base member 70. The third crank arm rotational axis 54 is laterally offset from a straight line extending through the first and second crank arm rotational axes 46, 50 and located between the first and second crank arm rotational axes 46, 50. The fourth crank arm 56 connects the linking member 42 to the base member 70 such that the fourth crank arm 56 is connected to the linking member 42 at a fourth crank arm rotational axis 58 and motion of the linking member 42 causes the fourth crank arm 56 to rotate with respect to the base member 70. The fourth crank arm rotational axis 58 is laterally offset from a straight line extending through the first and second crank arm rotational axes 46, 50, and located between the first and second crank arm rotational axes 46, 50. (see FIG. 4). In certain examples, the third crank arm rotational axis 54 and the fourth crank arm rotational axis 58 are disposed on opposite sides of the straight line extending through the first and second crank arm rotational axes 46, 50. The third and fourth crank arm 52, 56 are connected to the base member 70 and the linking member 42 with bearing and through shaft assemblies 131 positioned in bearing housings 130, as described with reference to the first and second crank arms 44, 48.

In non-limiting examples, the exercise device 10 includes a frame 80, a pedal member 90 having a first portion 92 and a second portion 94, the base member 70 having a first portion 72 and a second portion 74, and a crank arm 96 that has a first portion 97 that is pivotally coupled to the first portion 92 of the pedal member 90 and the second portion 94 that is pivotally coupled to the first portion 72 of the base member 70 along driving member rotational axis 22 via the driving member 20. (see FIG. 4). The second portion 74 of the base member 70 is pivotally connected to the frame 80 by the driven member 30. The crank arm 96 is rotatable in a circular path entirely around the first portion 72 of the base member 70, around driving member rotational axis 22, as the base member 70 pivots back and forth with respect to the frame 80 along with the pedal member 90 such that the pedal member 90 is movable along user defined paths of differing dimensions. The linkage assembly 40 links the driving member 20 to the driven member 30 such that rotation of the driving member 20 causes rotation of the driven member 30.

Figure 5:
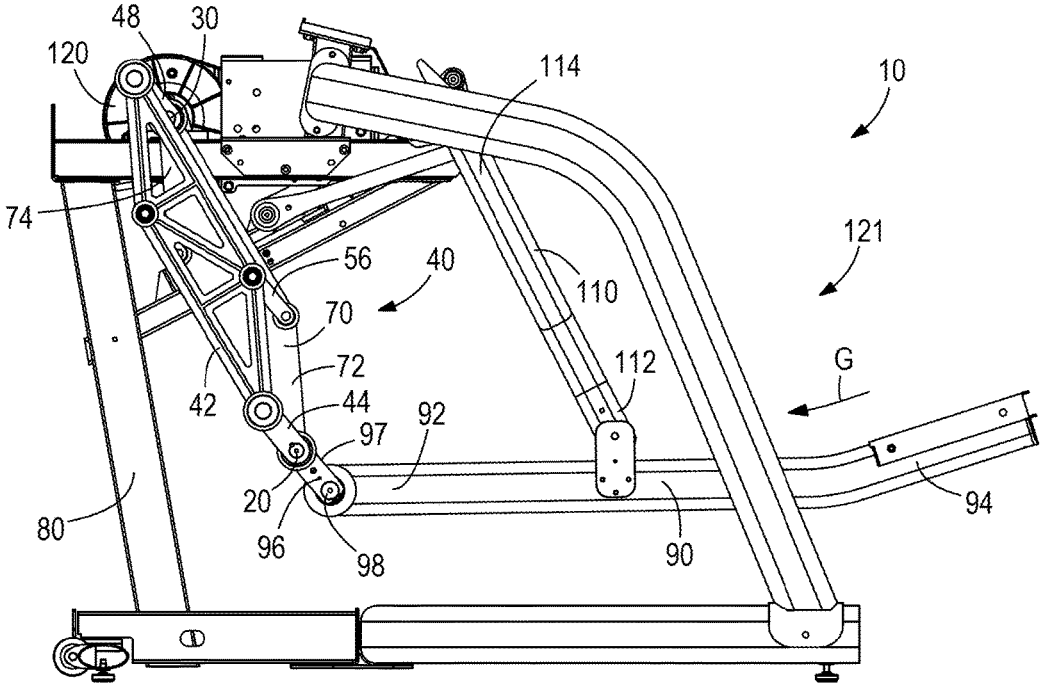
FIG. 5 is a side view of the exercise device of FIG. 2 in a first position.
Figure 6:
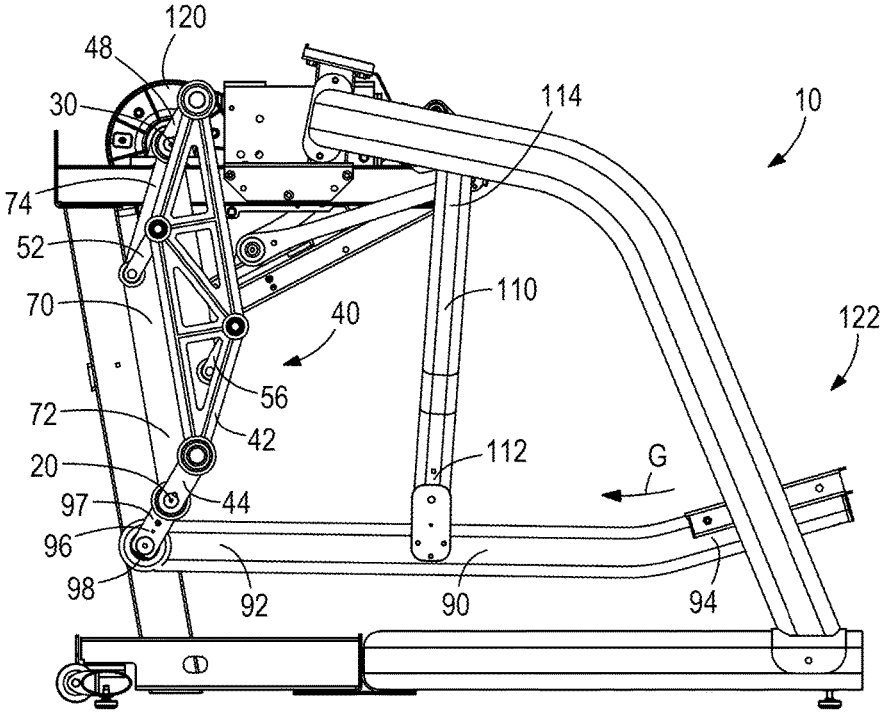
FIG. 6 is a side view of the exercise device of FIG. 2 in a second position.
Figure 7:
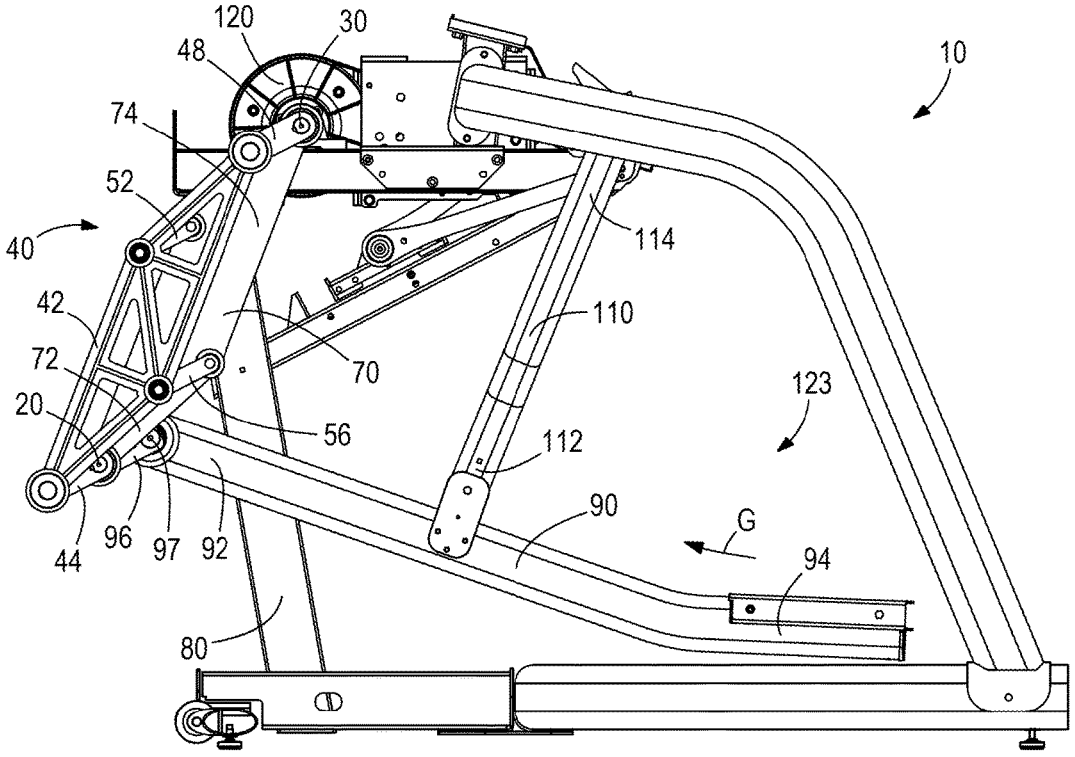
FIG. 7 is a side view of the exercise device of FIG. 2 in a third position.

Referring to FIGS. 5-7 depict movement of the exercise device 10. (see also U.S. Pat. No. 9,114,275 incorporated herein by reference). Referring to FIG. 5, the exercise device 10 is depicted in a first position 121. When the pedal member 90 moves in direction G, the pedal member 90 causes the crank arm 96 to rotate clockwise and thereby rotate the driving member 20 clockwise. The driving member 20 rotating clockwise causes the first crank arm 44, second crank arm 48, third crank arm 52, and fourth crank arm 56 to rotate in clockwise whereby the driven member 30 is rotated clockwise (see exercise device 10 in a second position 122 depicted in FIG. 6). During the rotation described above, the base member 70 and linking member 42 translate along circular paths with respect to each other. Continued movement of the pedal member 90 along direction G, as depicted in FIG. 6, causes further clockwise rotation of the driving member 20, first crank arm 44, second crank arm 48, third crank arm 52, fourth crank arm 56, and driven member 30 and motion of the base member 70 and linking member 42. (see FIG. 7). Movement of the pedal member 90 in a direction opposite direction G (not shown) causes further clockwise rotation of the exercise device 10 components described above. It is possible for the driving member 20, also the other parts of the exercise device 10 described above, to rotate in a counterclockwise direction.

The linkage assembly 40 can reduce vibration and/or noise of a timing belt system (see the examples disclosed in U.S. Pat. No. 9,114,275 incorporated herein by reference) when the exercise device 10 is operated at high speeds. The linkage assembly 40 reduces the number of components of the exercise device 10 when compared to known exercise devices, and the absence of the timing belt system makes pre-tensioning of the timing belt system unnecessary, as there is inherently constant load on the linkage assembly 40, driving member 20, and/or the driven member 30. The linkage assembly 40 comprises solid components such that the linkage assembly 40 has high stiffness. The linkage assembly 40 is a combination of multiple parallel double crank linkages which are capable of transmitting rotational motion as described above. In operation, the rotation of the first crank arm 44 determines the rotation of the second, third, and fourth crank arms 48, 52, 56, such that the all the crank arms 44, 48, 52, 56 rotate in the same direction. Further, any combination of crank arms 44, 48, 52, 56 can rotate at the same angular velocity relative to each other. It is possible for the linkage assembly 40 to operate, as described above with reference to four crank arms 44, 48, 52, 56, with three crank arms.

The exercise device 10 described herein transfers generally equal rotational motion from the driving member 20 to the driven member 30 while overcoming the drawbacks of slippage associated with flat- or v-belts or noise, flexibility, and/or vibration of the timing belt and/or related systems.

Through research and experimentation, the inventor has discovered that a typical parallel 4-bar linkage assembly known in the art does not provide with the advantages described herein with reference to the exercise device 10. In a conventional parallel 4-bar linkage or double crank assembly, the first crank arm (driving crank) and the second crank arm (driven crank) have the same length, and the driving crank and the driven crank are each connected to both a link and a frame such that the pin-to-pin distance is the same. Theoretically, the rotation of driven crank (i.e. same angular velocity/acceleration) can be exactly the same as that of the driving crank, but due to the singularity at the position where the driving crank and the driven crank are in-line with the link, a real-world implementation of the system will not work as described. For example, if the driving crank and the driven crank are held as the cranks are rotated in the system, both of the cranks will rotate in the same direction. However, if only one of the cranks is held during rotation, the free crank will tend to rotate in opposite direction of the intended rotation after the tangle point of the system. Further, the free crank will stop at the other tangle point followed by rotation in the same direction as that of the driving crank. This issue prevented the conventional 4-bar linkage system, although simple, from being used in real-world applications (such as exercise machines). An example of an exception are locomotive wheels due to the special conditions all the locomotive wheels on a railroad track cannot rotate in different directions.

A third crank arm added to the system in-line and parallel with respect to the driving member and the driven member creates an inline three-crank system which prevents opposite rotations of driving crank and the driven crank. Adding the third crank arm will work when dragging the driving crank through circular rotation. However, due to tolerance deviations and deformation under loadings of real world components, the inline three-crank system will stop at the tangle point.

In another system, the use of a four crank system on both sides of a frame, which is known in the art, works to translate rotation between the driving crank and the driven crank. The downside of the four-crank system on both sides of a frame is that it requires two sets of cranks and a pair of links, whereby one set of cranks and one link is positioned on different sides of the frame. If both sub-assemblies were on the same side of the frame, full circular rotation of the driving crank and the driven crank would result in one of the links cutting through the driving member or driven member such that it would be impossible to transmit full rotation from the driving member to the driven member (commonly known as "four crank on one side-not working").

In some applications, the selected linkage system must be positioned on one side of the frame. When adding a third crank arm of the same length between the frame and link in an arrangement such that the three pivoting shafts (driving member, driven member, and pivot shaft of the third crank arm) are situated on the frame, the orientation of the pivoting shafts does not form a straight line, but rather a triangle. In this orientation, the driving crank can be easily moved such that the driven crank and the third crank arm will rotate with the rotation of the driving crank with no difficulties (i.e. the driven crank and third crank arm will not stop or reverse rotation at the tangle point). Further the third crank arm is offset from a line formed between the driving member and the driven member because the system would not work if all three pivoting shafts are on the same line. Further, best results occur with the triangle formed by the three pivoting points has maximum area.

When the distance between the driving member and driven member are further apart, the addition of the third crank arm with a large offset would significantly increase the size of the system and limit/prohibit its application. A fourth crank arm can be added in such cases to keep the system from become too wide (in terms measured along the line connecting driving/driven shaft). An example implementation is shown in the drawings, wherein a rhombus area is formed by the 4 pivoting shafts (driving member, driven member, pivot shaft of the third crank arm, and pivot shaft of the fourth crank arm) being twice as large as the triangle formed by three pivoting shafts.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An exercise device comprising:

a driving member;

a driven member; and a linkage assembly that links the driving member to the driven member such that rotation of the driving member causes rotation of the driven member;

wherein the linkage assembly comprises a linking member, a base member that connects the driving member and the driven member, a first crank arm that connects the driving member to the linking member such that rotation of the driving member causes motion of the linking member, a second crank arm that connects the linking member to the driven member such that the motion of the linking member causes rotation of the driven member, and a third crank arm that is separate and spaced apart from the first and second crank arms, wherein the third crank arm connects the linking member to the base member such that the motion of the linking member causes the third crank arm to rotate with respect to the base member; and wherein the driving member comprises a first rotatable shaft, the driven member comprises a second rotatable shaft, and the base member is connected to and extends between the first and second rotatable shafts.

2. The exercise device according to claim 1, wherein the first, second, and third crank arms extend in a common plane.

3. The exercise device according to claim 2, wherein the first and second crank arms remain parallel to each other as the driving member is rotated.

4. The exercise device according to claim 2, wherein the first crank arm is connected to the driving member at a driving member rotational axis, wherein the second crank arm is connected to the driven member at a driven member rotational axis, and wherein the driving member rotational axis and the driven member rotational axis are parallel and spaced apart with respect to each other.

5. The exercise device according to claim 4, wherein rotation of the driving member causes the first crank arm to rotate about the driving member rotational axis, the linking member to move relative to the driving member rotational axis and the driven member rotational axis, and the second crank arm to rotate about the driven member rotational axis.

6. The exercise device according to claim 5, wherein the driving member rotational axis and the driven member rotational axis remain at a fixed distance from each other during said rotation of the driving member.

7. The exercise device according to claim 2, wherein the first crank arm is connected to the linking member at a first crank arm rotational axis, wherein the second crank arm is connected to the linking member at a second crank arm rotational axis, and wherein the first crank arm rotational axis and second crank arm rotational axis are parallel and spaced apart with respect to each other.

8. The exercise device according to claim 7, wherein the third crank arm is connected to the linking member at a third crank arm rotational axis, and wherein the third crank arm rotational axis is laterally offset from a straight line extending through the first and second crank arm rotational axes.

9. The exercise device according to claim 2, wherein the base member supports rotation of the driving member, driven member, first crank arm, second crank arm, and third crank arm and motion of the linking member.

10. The exercise device according to claim 9, wherein said motion of the linking member is translation along a circular path with respect to the base member.

11. The exercise device according to claim 8, further comprising a fourth crank arm that connects the linking member to the base member, wherein the fourth crank arm is connected to the linking member at a fourth crank arm rotational axis, wherein said rotation of the linking member causes the fourth crank arm to rotate with respect to the base member, and wherein the first, second, third, and fourth crank arms extend in a common plane.

12. The exercise device according to claim 11, wherein the third crank arm rotational axis and fourth crank arm rotational axis are located between the first and second crank arm rotational axes and are laterally offset on opposite sides of a straight line extending through the first and second crank arm rotational axes.

13. The exercise device according to claim 12, wherein the base member comprises a plurality of bearing housings for supporting rotation of the driving member, driven member, first crank arm, second crank arm, third crank arm, and fourth crank arm with respect to the base member.

14. The exercise device according to claim 1, further comprising a driving crank arm that drives rotation of the driving member.

15. The exercise device according to claim 1, further comprising a resistance member that resists rotation of the driven member.

16. An exercise device comprising:

a driving member;

a driven member;

a linkage assembly that links the driving member to the driven member such that rotation of the driving member causes rotation of the driven member;

wherein the linkage assembly comprises a linking member, a base member that connects the driving member and the driven member, a first crank arm that connects the driving member to the linking member at a first crank arm rotational axis such that rotation of the driving member causes motion of the linking member, a second crank arm that connects the linking member to the driven member at a second crank arm rotational axis such that rotation of the linking member causes rotation of the driven member, and a third crank arm that is separate and spaced apart from the first and second crank arms, wherein the third crank arm connects the linking member to the base member at a third crank arm rotational axis such that the motion of the linking member causes the third crank arm to rotate with respect to the base member;

wherein the first, second, and third crank arms extend in a common plane and remain parallel to each other as the driving member rotates; and wherein the third crank arm rotational axis is laterally offset from a straight line extending through the first and second crank arm rotational axes; and a driving crank arm that drives rotation of the driving member;

wherein the driving member comprises a first rotatable shaft, the driven member comprises a second rotatable shaft, and the base member is connected to and extends between the first and second rotatable shafts.

17. The exercise device according to claim 16, further comprising a resistance member that resists rotation of the driven member.

18. An exercise device comprising:

a frame;

a pedal member having a first portion and a second portion;

a base member having a first portion and a second portion, wherein the second portion of the base member is pivotally coupled to the frame via a driven member;

a crank arm that has a first portion that is pivotally coupled to the first portion of the pedal member and a second portion that is pivotally coupled to the first portion of the base member via a driving member; and wherein the crank arm is rotatable in a circular path entirely around the first portion of the base member as the base member pivots back and forth with respect to the frame such that the pedal member is movable along user defined paths of differing dimensions; and a linkage assembly that links the driving member to the driven member such that rotation of the driving member causes rotation of the driven member;

wherein the linkage assembly comprises a linking member, a first crank arm that connects the driving member to the linking member at a first crank arm rotational axis such that rotation of the driving member causes motion of the linking member, a second crank arm that connects the linking member to the driven member at a second crank arm rotation axis such that rotation of the linking member causes rotation of the driven member, and a third crank arm that connects the linking member to the base member at a third crank arm rotational axis such that the motion of the of the linking member causes the third crank arm to rotate with respect to the base member;

wherein the first, second, and third crank arms extend in a common plane and remain parallel to each other as the driving member rotates;

wherein the third crank arm rotational axis is laterally offset from a line extending through the first and second crank arm rotational axes; and wherein the driving member comprises a first rotatable shaft, the driven member comprises a second rotatable shaft, and the base member is connected to and extends between the first and second rotatable shafts.

19. The exercise device according to claim 18, further comprising a rocker arm having a first portion that is pivotally coupled to the pedal member between the first and second portions of the pedal member wherein the rocker arm further has a second portion that is pivotally coupled to the frame.

20. The exercise device according to claim 19, further comprising a resistance member that resists rotation of the driven member.

* * * * *